US010773533B1

(12) United States Patent
Inokuchi

(10) Patent No.: US 10,773,533 B1
(45) Date of Patent: Sep. 15, 2020

(54) PRINTER

(71) Applicants: CITIZEN WATCH CO., LTD., Tokyo (JP); CITIZEN SYSTEMS JAPAN CO., LTD., Tokyo (JP)

(72) Inventor: Yutaka Inokuchi, Iida (JP)

(73) Assignees: CITIZEN WATCH CO., LTD., Tokyo (JP); CITIZEN SYSTEMS JAPAN CO., LTD., Tokyo (JP)

( * ) Notice: Subject to any disclaimer, the term of this patent is extended or adjusted under 35 U.S.C. 154(b) by 0 days.

(21) Appl. No.: 16/814,915

(22) Filed: Mar. 10, 2020

(30) Foreign Application Priority Data

Mar. 11, 2019 (JP) ..... 2019-043543

(51) Int. Cl.

| | |
|---|---|
| ***B41J 11/20*** | (2006.01) |
| ***B41J 11/02*** | (2006.01) |
| ***B41J 2/32*** | (2006.01) |
| ***B41J 11/04*** | (2006.01) |
| ***B41J 2/325*** | (2006.01) |
| *B41J 15/04* | (2006.01) |

(52) U.S. Cl.
CPC ..... *B41J 11/20* (2013.01); *B41J 2/32* (2013.01); *B41J 2/325* (2013.01); *B41J 11/02* (2013.01); *B41J 11/04* (2013.01); *B41J 15/04* (2013.01)

(58) Field of Classification Search
CPC ... B41J 11/02; B41J 11/20; B41J 11/04; B41J 2/32; B41J 2/325; B41J 15/04
See application file for complete search history.

(56) References Cited

U.S. PATENT DOCUMENTS

| | | | | |
|---|---|---|---|---|
| 5,085,533 | A | 2/1992 | Kitahara | |
| 2003/0197775 | A1 | 10/2003 | Sato | |
| 2006/0233579 | A1 | 10/2006 | Ono | |
| 2011/0128341 | A1 | 6/2011 | Takahashi | |
| 2011/0203467 | A1* | 8/2011 | Naito | B41J 3/4075 101/212 |

FOREIGN PATENT DOCUMENTS

| | | | |
|---|---|---|---|
| EP | 2990364 | A1 | 3/2016 |
| JP | H03128254 | A | 5/1991 |
| JP | 6328810 | A | 11/1994 |
| JP | 2001080154 | A | 3/2001 |
| JP | 2003118153 | A | 4/2003 |
| JP | 2003312030 | A | 11/2003 |
| JP | 2006297682 | A | 11/2006 |
| JP | 2011110917 | A | 6/2011 |
| JP | 2012025013 | A | 2/2012 |
| JP | 2012218288 | A | 11/2012 |

* cited by examiner

*Primary Examiner* — Geoffrey S Mruk
(74) *Attorney, Agent, or Firm* — Tucker Ellis LLP

(57) ABSTRACT

A printer includes a transport roller (driving roller, driven roller, counter roller) that is disposed in a casing, and configured to transport a sheet to be fed from roll paper, an image forming portion (thermal head) that is disposed in a cover (upper cover) of the casing, and configured to form an image on the sheet; and a platen roller that is disposed in the casing to face the image forming portion (thermal head). The image forming portion (thermal head) is movable in transport directions (feeding direction, drawing back direction) of the sheet, and the platen roller is movable in directions substantially vertical to the transport directions (feeding direction, drawing back direction).

4 Claims, 8 Drawing Sheets

PRINTER

CROSS-REFERENCE TO RELATED APPLICATION

The present application is based on and claims priority to Japanese patent application No. 2019-043543, filed on Mar. 11, 2019, the disclosure of which is hereby incorporated by reference herein in its entirety.

BACKGROUND

The present disclosure relates to a printer.

Conventionally, a printer including a mechanism of aligning a platen roller and a thermal head is known (see, for example, JP2012-218288A).

JP2012-218288A discloses a configuration in which the platen roller is supported by a first support member and a second support member to be movable in a pressing direction to the thermal head and a direction vertical to the pressing direction within a predetermined range. The platen roller and the thermal head are thereby aligned.

SUMMARY

However, as the configuration described in JP2012-218288A includes a configuration that moves the platen roller in the two directions such as a pressing direction to the thermal head and a direction vertical to the pressing direction, the configuration that aligns the platen roller and the thermal head is complex.

It is therefore, an object of the present invention is to provide a printer capable of aligning a platen roller and an image forming portion with a simple configuration.

To achieve the above object, a printer includes a transport roller that is disposed in a casing, and transports a sheet to be fed from roll paper, an image forming portion that is disposed in a cover of the casing, and forms an image on the sheet, and a platen roller that is disposed in the casing to face the image forming portion, wherein the image forming portion is movable in transport directions of the sheet, and the platen roller is movable in directions substantially vertical to the transport directions.

DETAILED DESCRIPTION

With respect to the use of plural and/or singular terms herein, those having skill in the art can translate from the plural to the singular and/or from the singular to the plural as is appropriate to the context and/or application. The various singular/plural permutations may be expressly set forth herein for sake of clarity.

Hereinafter, an embodiment for achieving a printer of the present disclosure will be described with reference to drawings.

The printer in the embodiment is applied to a sublimation type thermal transfer printer.

Figure 1:
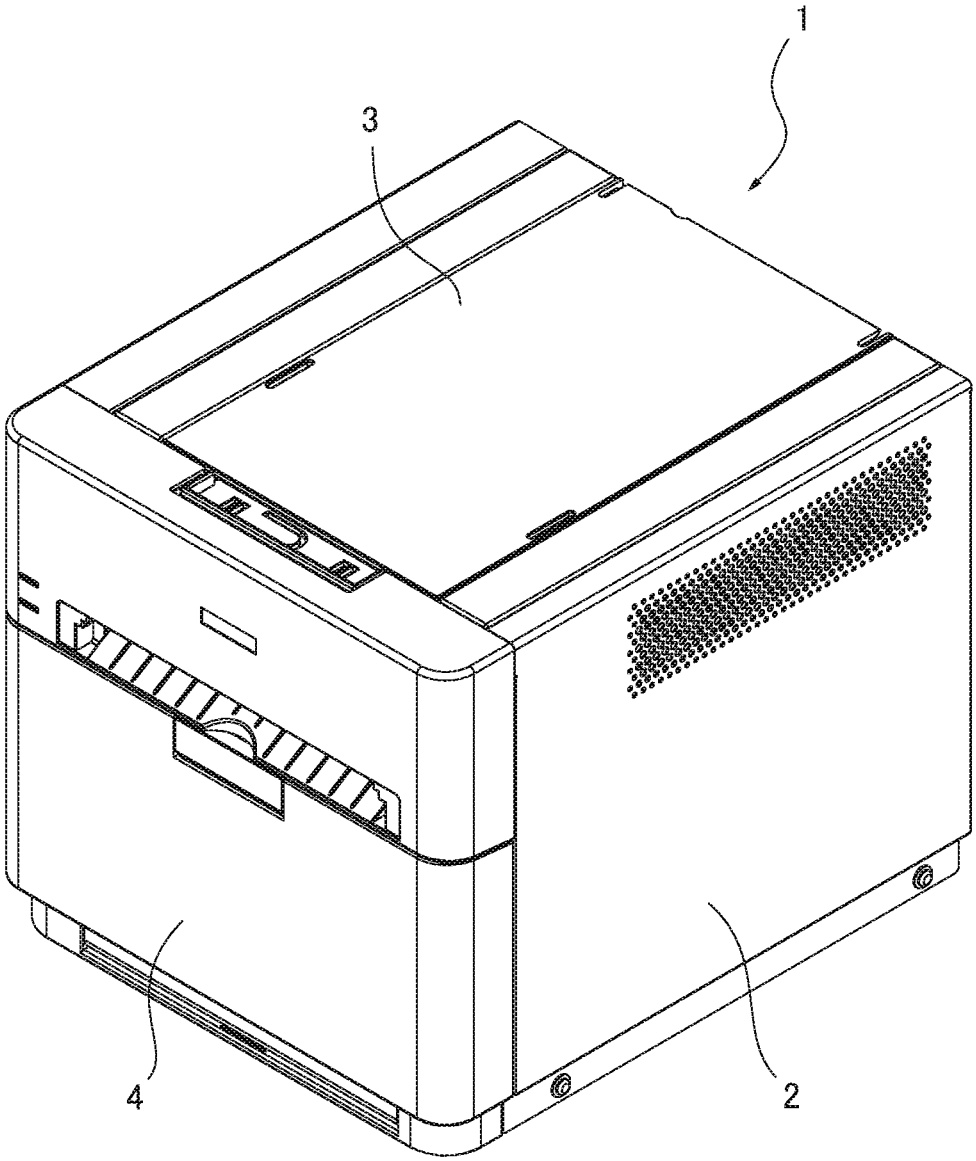
FIG. 1 is a perspective view illustrating a printer of an embodiment.
Figure 2:
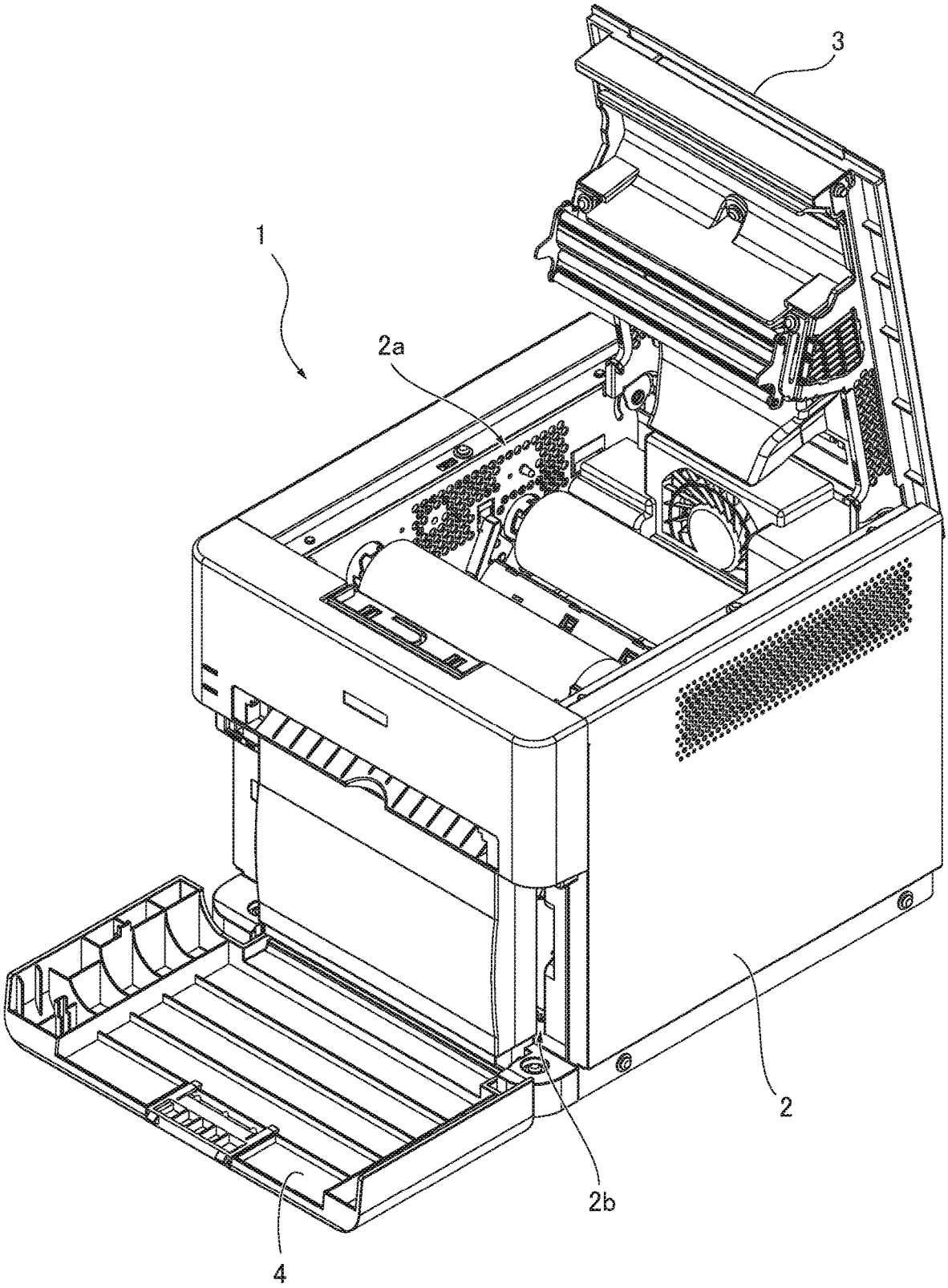
FIG. 2 is a perspective view illustrating the printer of the embodiment when a cover is open.
Figure 3:
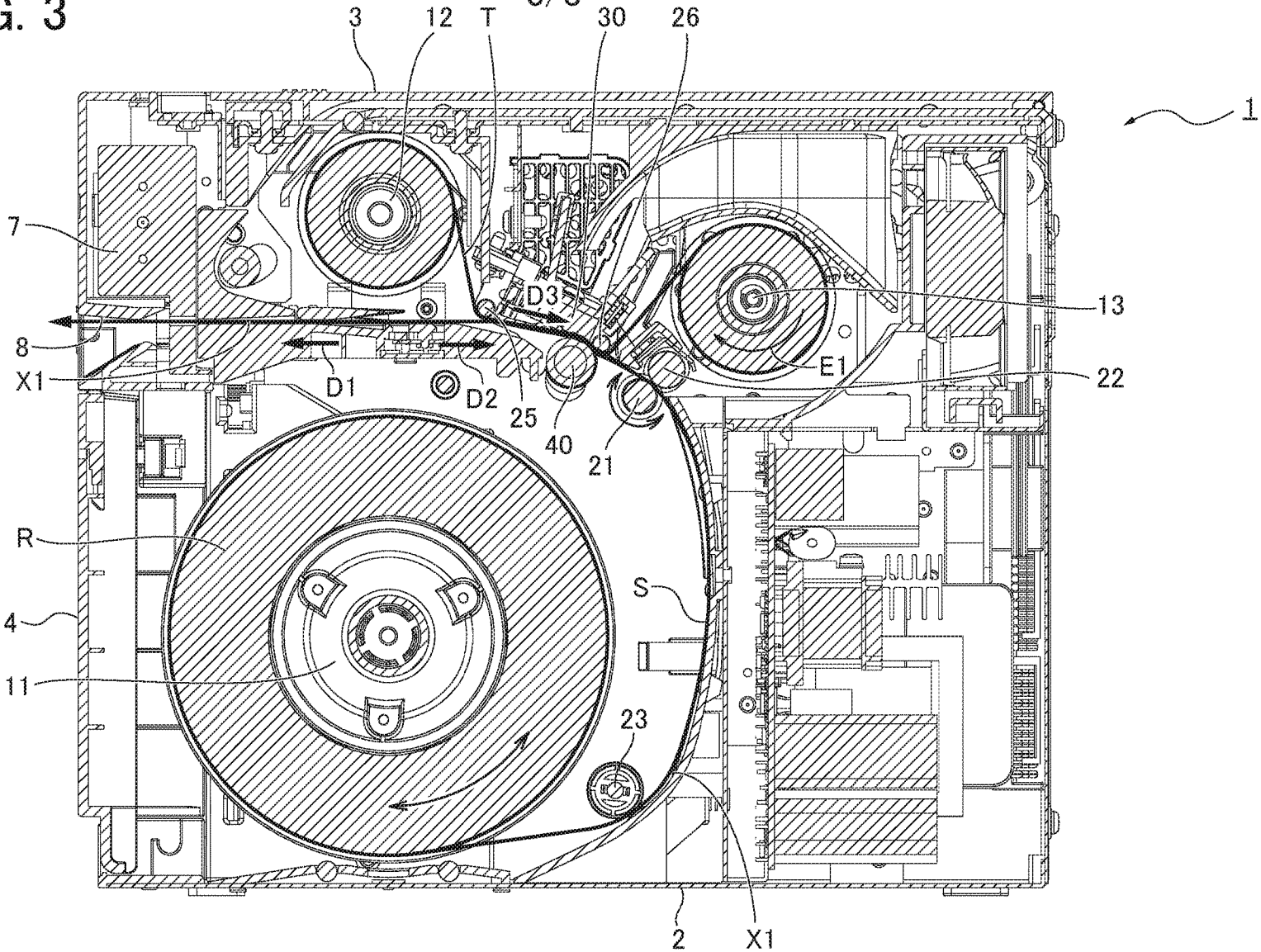
FIG. 3 is a cross section view illustrating a printer of the embodiment.

FIG. 1 is a perspective view illustrating the printer of the embodiment. FIG. 2 is a perspective view illustrating the printer of the embodiment when a cover is open. FIG. 3 is a cross section view illustrating the printer of the embodiment. Hereinafter, the configuration of the printer of the embodiment will be described with reference to FIGS. 1 to 3.

As illustrated in FIGS. 1, 2, the printer 1 includes a box casing 2, an upper cover 3 as a cover provided in an upper opening portion 2*a* formed in a top surface of the casing 2, and a front cover 4 provided in a front opening portion 2*b* formed in a front surface of the casing 2.

As illustrated in FIG. 3, the casing 2 includes, inside thereof, roll paper R which supplies a sheet S as a recording medium, an ink ribbon T, a thermal head 30 as an image forming portion, a platen roller 40, a cutter unit 7 as a cutting portion, and a driving roller 21 as a transport roller.

The sheet S fed from the roll paper R is wound around the driving roller 21 and a driven roller 23 as a transport roller. The sheet S is transported in a transport path X1 in a feeding direction D1 as a transport direction, and is discharged from an exit 8.

For example, photographic paper thicker than plain paper is used for the roll paper R. The roll paper R is rotatably held by a roll paper holder 11 connected to a motor.

The driving roller 21 and the driven roller 23 are attached to the casing 2, and are disposed along the transport path X1. The driving roller 21 is connected to a motor to be rotatable in a positive direction (counterclockwise direction) or a negative direction (clockwise direction) opposite to the positive direction. A counter roller 22 as a transport roller is disposed to face the driving roller 21.

The counter roller 22 is attached to the casing 2, and is disposed along the transport path X1. The counter roller 22 is movable to the driving roller 21. When the sheet S is transported, the counter roller 22 contacts the driving roller 21, and rotates according to the driving roller 21. When the driving roller 21 rotates in the positive direction, the driving roller 21 and the counter roller 22 transport the sheet S in the feeding direction D1 while sandwiching the sheet S therebetween. When the driving roller 21 rotates in the negative direction opposite to the positive direction, the driving roller 21 and the counter roller 22 transport the sheet S in a drawing back direction D2 as the transport direction while sandwiching the sheet S therebetween. The counter roller 22 separates from the driving roller 21 when the sheet S is not transported.

The thermal head 30 is attached to the upper cover 3, and is disposed along the transport path X1. The thermal head 30 is disposed downstream of the driving roller 21 in the feeding direction D1 of the sheet S.

The platen roller 40 is attached to the casing 2, and is disposed along the transport path X1 to face the thermal head 30.

The cutter unit 7 is attached to the casing 2, and is disposed in front of the exit 8 in the feeding direction D1. The cutter unit 7 cuts the sheet S which is transported in the transport path X1.

The ink ribbon T is a band-shaped sheet including respective ink regions for yellow Y, magenta M, and cyan C and a region for overcoat OP, which are repeatedly disposed in a longitudinal direction. The ink ribbon T is held by a ribbon supply reel 12 which feeds the ink ribbon T and a ribbon winding reel 13 which winds the ink ribbon T.

The ribbon winding reel 13 is connected to a motor to rotate in a rotation direction E1. When the ribbon winding reel 13 rotates in the rotation direction E1, the ink ribbon T is fed from the ribbon supply reel 12. The ink ribbon T fed from the ribbon supply reel 12 is transported in a ribbon transport direction D3 to pass between the thermal head 30 and the platen roller 40 via driven rollers 25, 26, and is wound around the ribbon winding reel 13.

Figure 4:
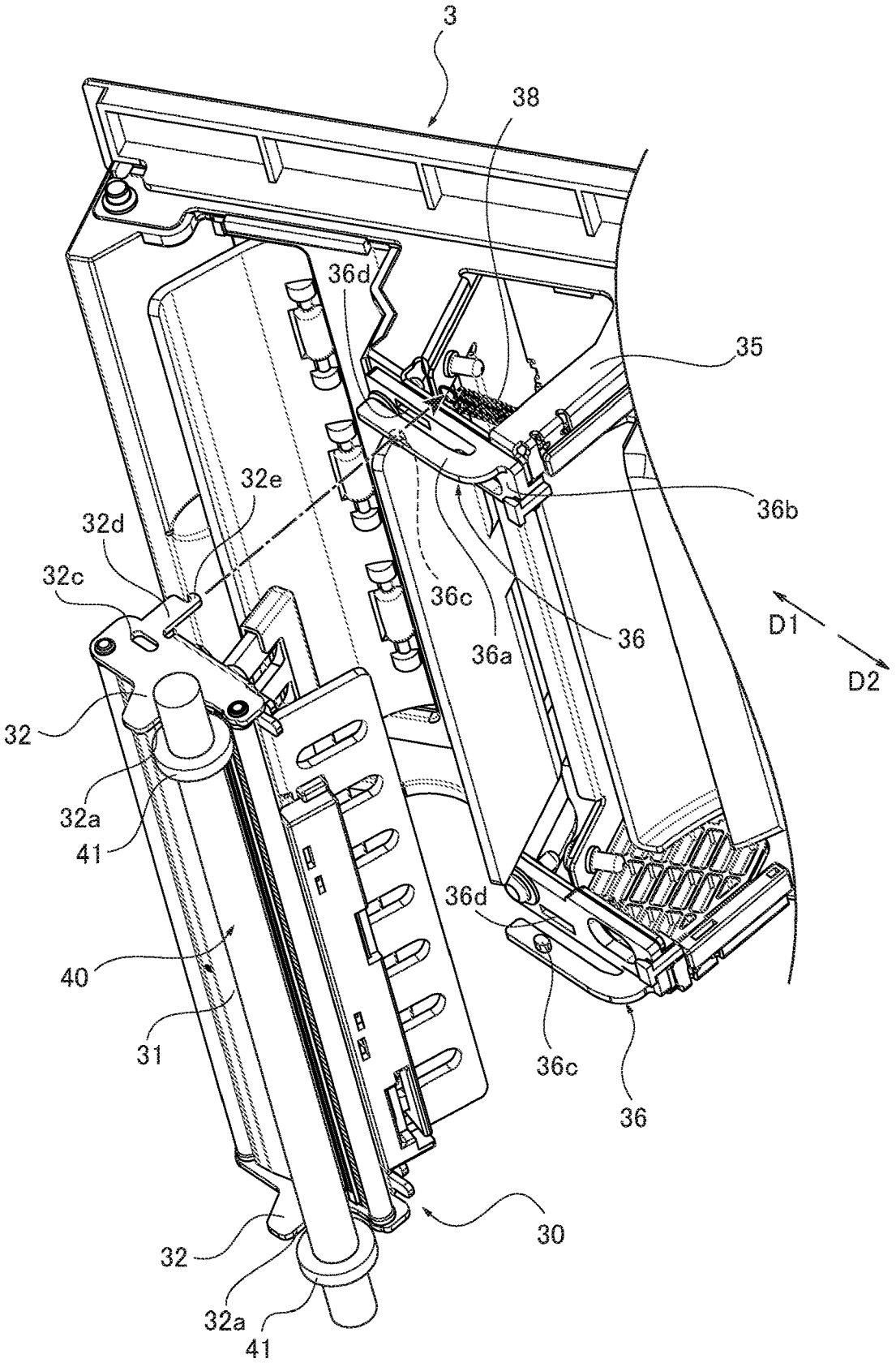
FIG. 4 is a perspective view describing a moving mechanism of a thermal head of the embodiment.

FIG. 4 is a perspective view describing a moving mechanism of the thermal head of the embodiment. Hereinafter, the moving mechanism of the thermal head 30 of the embodiment will be described with reference to FIG. 4.

The thermal head 30 includes a head main body 31 and a regulating member 32 attached to the head main body 31.

The thermal head 30 is supported by two supporting members 30 attached to a base member 35 via the regulating member 32. The base member 35 is attached to the upper cover 3.

The length of the head main body 31 in the longitudinal direction is longer than the width of the sheet S. The regulating member 32 is attached to both end portions of the head main body 31 in the longitudinal direction by a screw, for example. The regulating member 32 is disposed outside the sheet S in the width direction. The regulating member 32 includes a hole into which the screw is inserted. This hole may be a long hole, so that the position of the regulating member 32 to be attached to the thermal head 30 in the transport direction is adjustable.

The regulating member 32 is made of a sheet metal, and includes a first regulating portion 32*a*, an insertion hole 32*c*, a small piece portion 32*d*, and a hook portion 32*e*.

The first regulating portion 32*a* is provided in an outer edge of the regulating member 32. The first regulating portion 32*a* is disposed upstream of the platen roller 40 in the drawing back direction D2. The first regulating portion 32*a* extends in a direction substantially vertical to the transport direction (feeding direction D1, drawing back direction D2). The first regulating portion 32*a* contacts a bearing 41 of the platen roller 40 to regulate the thermal head 30 from moving in the drawing back direction D2.

The insertion hole 32*c* is a long hole having a long side in the transport direction. An after-described projection portion 36*c* is inserted into the insertion hole 32*c*.

The small piece portion 32*d* extends upward, and includes, in the leading end thereof, the hook portion 32*e*. A tension spring 38 as an after-described first biasing member is attached to the hook portion 32*e*.

The support member 36 is made of resin, and includes a first wall 36*a* and a second wall 36*b* to have an L shape in section. The first wall 36*a* includes a cylindrical projection portion 36*c* projecting toward the other support member 36. The second wall 36*b* includes a through-hole 36*d* into which the small piece portion 32*d* is inserted. The length of the through-hole 36*d* in the longitudinal direction is longer than the width of the small piece portion 32*d*.

A first end of the tension spring 38 as the first biasing member is attached to the base member 35 and a second end of the tension spring 38 is attached to the hook portion 32*e*.

When the thermal head 30 is attached to the support member 36, an outer surface of the regulating member 32 contacts an inner surface of the first wall 36*a* of the support member 36, and the thermal head 30 is regulated from moving in the longitudinal direction of the head main body 31.

The projection portion 36*c* of the support member 36 is inserted into the insertion hole 32*c* of the regulating member 32, and the thermal head 30 is regulated from moving in the directions vertical to the transport directions (feeding direction D1, drawing back direction D2).

The small piece portion 32*d* of the regulating member 32 is inserted into the through-hole 36*d* of the support member 36, and the second end of the tension spring 38 is hooked to the hook portion 32*e*. The hook portion 32*e* is thereby biased in the drawing back direction D2.

The thermal head 30 is thereby movable in the transport directions (feeding direction D1, drawing back direction D2) only. That is, the thermal head 30 is immovable in the directions vertical to the transport directions (feeding direction D1, drawing back direction D2) and the longitudinal direction of the head main body 31.

The thermal head 30 is biased in the drawing back direction D2 by the tension spring 38. That is, when an image is formed on the sheet S, the thermal head 30 is biased in the drawing back direction D2 in which the sheet S is transported. The first regulating portion 32*a* is configured to regulate the thermal head 30 from moving in the drawing back direction D2.

Figure 5:
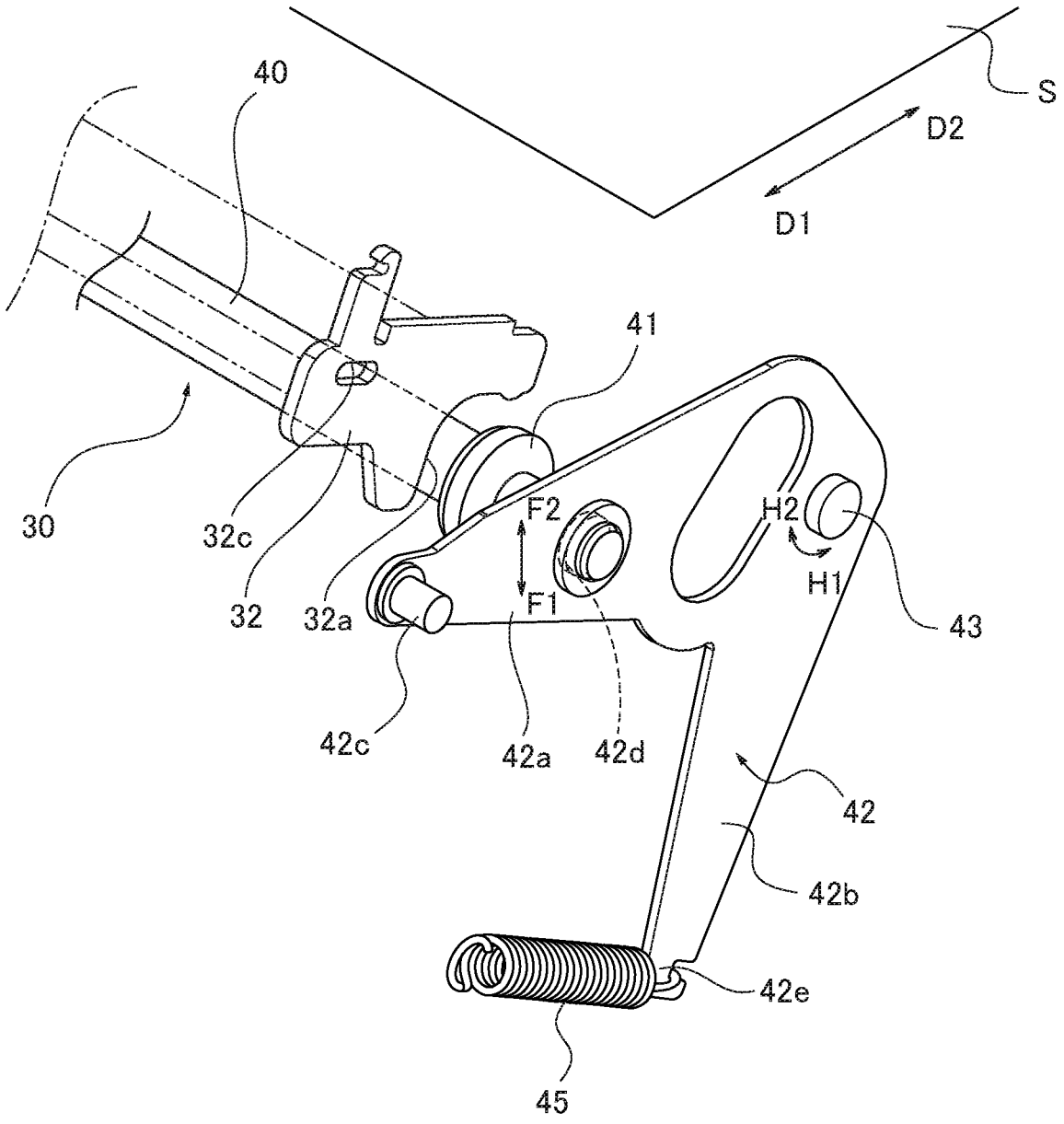
FIG. 5 is a perspective view describing a moving mechanism of a platen roller of the embodiment.

FIG. 5 is a perspective view describing a moving mechanism of the platen roller 40 of the embodiment. Hereinafter, the moving mechanism of the platen roller 40 of the embodiment will be described with reference to FIG. 5.

The platen roller 40 includes the bearing 41 outside the sheet S to be fed in the width direction. The platen roller 40 is attached to the casing 2 via a lever 42. The bearing 41 is provided according to the regulating member 32. That is, the bearing 41 is disposed outside the sheet S in the width direction.

The lever 42 is made of metal, for example, and includes a first arm portion 42*a* and a second arm portion 42*b* to have a V shape. A convex portion 42*c* is provided in a leading end of the first arm portion 42*a*. The first arm portion 42*a* is provided with a through-hole 42*d* into which an end portion of the platen roller 40 is inserted to be rotatably supported.

The leading end of the second arm portion 42*b* is provided with a hook portion 42*e*. A first end of a tension spring 45 as a second biasing member is hooked to the hook portion 42*e*. A second end of the tension spring 45 is fixed to the casing 2.

The first arm portion 42*a* includes, in a root portion thereof, a rotation shaft 43 about which the lever 42 rotates. The rotation shaft 43 is attached to the casing 2, for example.

The convex portion 42*c* is pushed downwardly by a not shown cam. The lever 42 thereby rotates in a direction H1. In this case, the platen roller 40 moves in a direction F1 separating from the thermal head 30. The direction F1 is substantially vertical to the transport directions (feeding direction D1, drawing back direction D2).

When the amount of pushing the convex portion 42*c* downwardly by the cam is decreased, the lever 42 rotates in a direction H2. In this case, the platen roller 40 moves in a direction F2 coming close to the thermal head 30. The direction F2 is substantially vertical to the transport directions (feeding direction D1, drawing back direction D2). In this case, the lever 42 is biased in the direction H2 by the tension spring 45. That is, the platen roller 40 is biased in the direction F2 coming close to the thermal head 30 by the tension spring 45. The platen roller 40 is thereby pushed to the thermal head 30.

The platen roller 40 is thereby movable in the direction vertical to the transport directions (feeding direction D1, drawing back direction D2) only. That is, the platen roller 40 is immovable in the transport directions.

Figure 6:
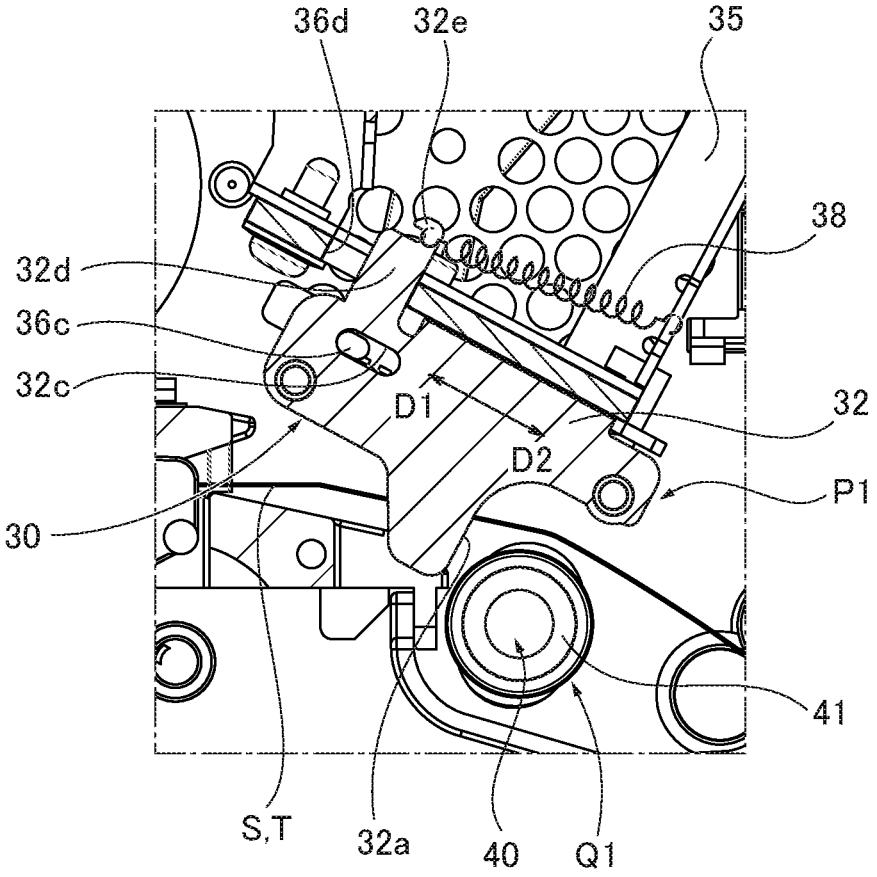
FIG. 6 is a cross section view illustrating the thermal head in an initial position and the platen roller in an initial position in the embodiment.
Figure 7:
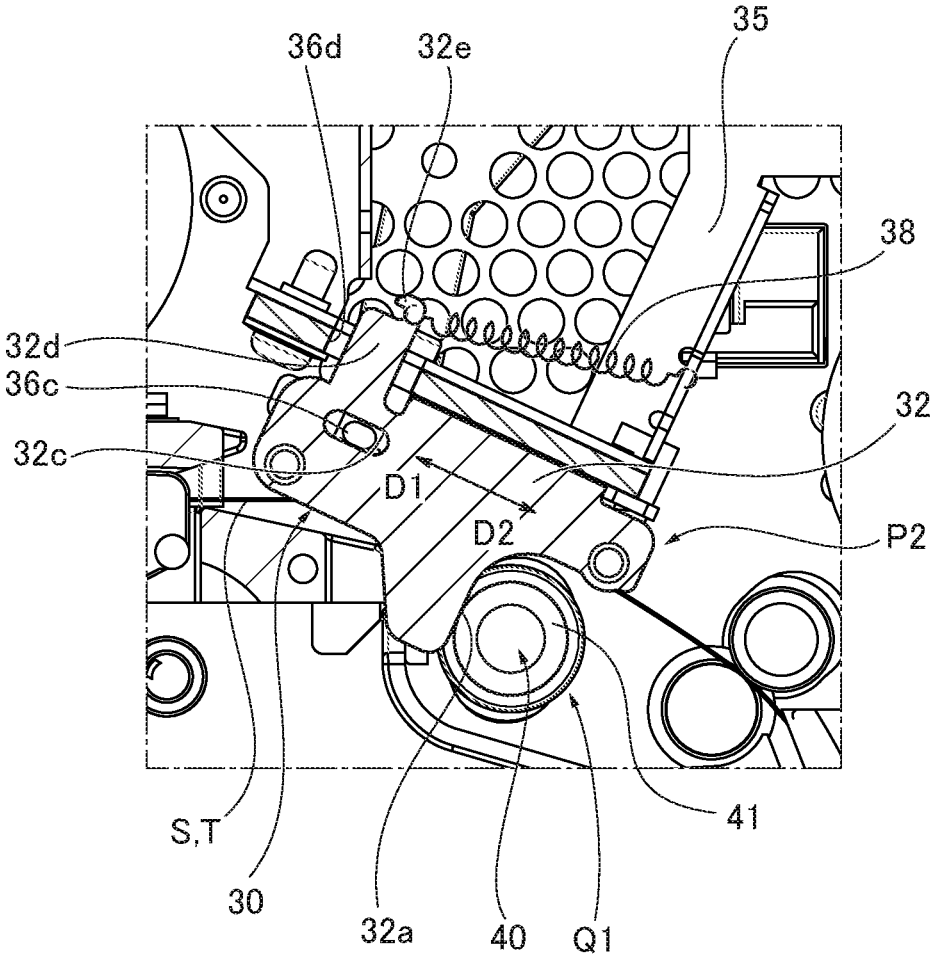
FIG. 7 is a cross section view illustrating the thermal head in a standby position and the platen roller in the initial position in the embodiment.
Figure 8:
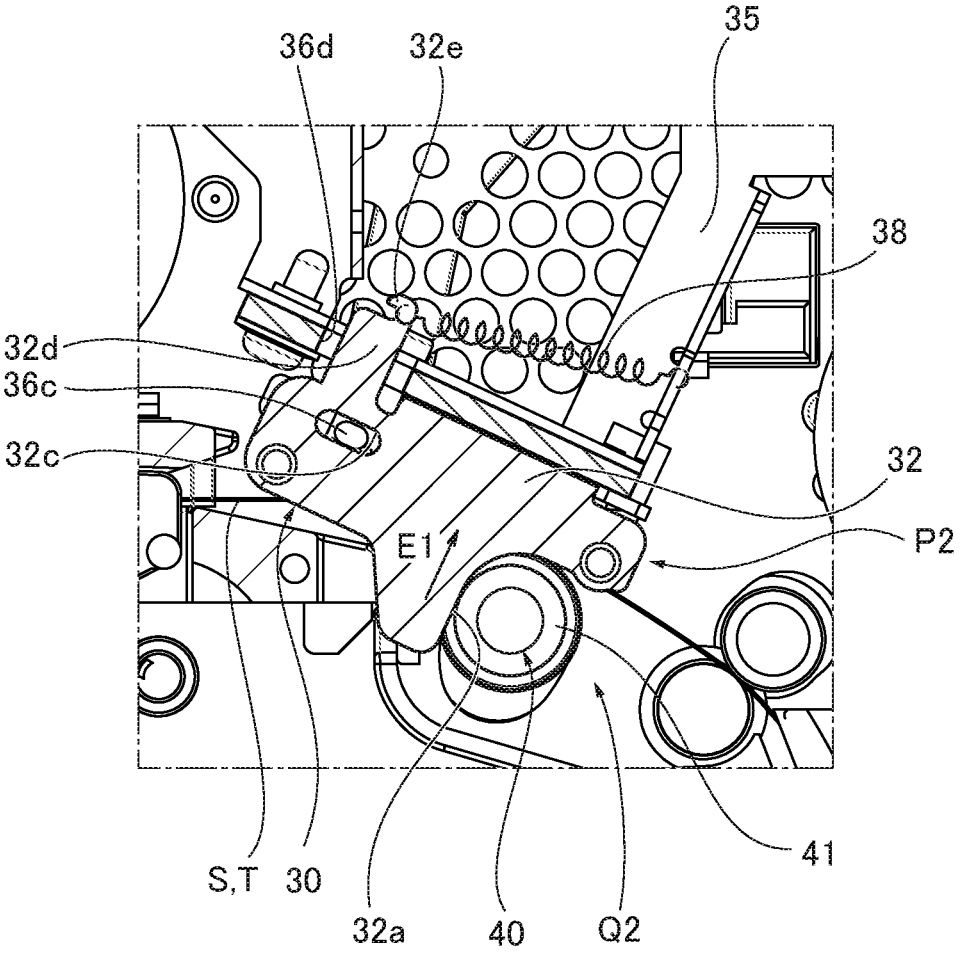
FIG. 8 is a cross section view illustrating the thermal head in the standby position and the platen roller in a pressed position in the embodiment.

FIG. 6 is a cross section view illustrating the thermal head 30 in an initial position and the platen roller 40 in an initial position in the embodiment. FIG. 7 is a cross section view illustrating the thermal head 30 in a standby position and the platen roller 40 in the initial position. FIG. 8 is a cross section view illustrating the thermal head 30 in the standby position and the platen roller 40 in a pressed position. Hereinafter, the operation of the printer 1 of the embodiment will be described with reference to FIG. 3 and FIGS. 6 to 8.

In the printer 1 configured as described above, when the upper cover 3 is open, as illustrated in FIG. 6, the thermal head 30 is biased by the tension spring 38 in the drawing back direction D2, and the small piece portion 32*d* contacts the side of the through-hole 36*d*. The thermal head 30 is thereby located in an initial position P1 which is a rear position in the printer 1. In this case, the platen roller 40 is located in an initial position Q1 separated from the thermal head 30.

When the upper cover 3 is closed, as illustrated in FIG. 7, the first regulating portion 32*a* of the regulating member 32 contacts the bearing 41 of the platen roller 40, and the thermal head 30 moves to a standby position P2 moved in the feeding direction D1 against the biasing force of the tension spring 38. In this case, the platen roller 40 is located in the initial position Q1 separated from the thermal head 30.

When image data is input to the printer 1 to start a printing operation, as illustrated in FIG. 3, the roll paper holder 11 rotates and the driving roller 21 rotates in the positive direction, so that the sheet S fed from the roll paper R is transported in the transport path X1 in the feeding direction D1.

Next, the sheet S is transported in the drawing back direction D2, and an image is formed on the sheet S by the thermal head 30.

In this case, as illustrated in FIG. 8, the platen roller 40 moves to a pressed position Q2 which presses the thermal head 30. When the platen roller 40 is located in the pressed position Q2, and the thermal head 30 is pressed by the platen roller 40 via the sheet S and the ink ribbon T, the thermal head 30 generates heat, and transfers sublimating dye ink applied to the ink ribbon T onto the same area of the sheet S to form the image on the sheet S.

The sheet S is repeatedly reciprocated in accordance with the formation of the image of each color (yellow Y, magenta M, cyan C, and overcoat OP), and an image in which the respective colors are combined is formed on the same area of the sheet S.

Next, the sheet S is transported in the transport path X1 in the feeding direction D1, is cut by the cutter unit 7, and is discharged from the exit 8.

An operation of the printer of the embodiment will be described. The printer 1 of the embodiment includes the transport roller (driving roller 21, driven roller 23, counter roller 22) that is disposed in the casing 2 and transports the sheet S fed from the roll paper R, the image forming portion (thermal head 30) that is disposed in the cover (upper cover 3) of the casing 2 and forms the image on the sheet S, and the platen roller 40 that is disposed in the casing 2 to face the image forming portion (thermal head 30). The image forming portion (thermal head 30) is movable in the transport directions (feeding direction D1, drawing back direction D2) of the sheet S, and the platen roller 40 is movable in the directions (direction F1, direction F2) substantially vertical to the transport directions (feeding direction D1, drawing back direction D2) (FIG. 3).

In the transport directions (feeding direction D1, drawing back direction D2), when the platen roller 40 and the image forming portion (thermal head 30) are relatively displaced, the printing result to be obtained is changed. When the platen roller 40 and the image forming portion (thermal head 30) are relatively located in the most appropriate positions, a preferable printed object (picture) is obtained. On the other hand, when the platen roller 40 and the image forming portion (thermal head 30) are not relatively located in appropriate positions, the printed result may be blurred or the ink ribbon T may be wrinkled. Such a wrinkle may be transferred onto a picture.

In the embodiment, the image forming portion (thermal head 30) moves in the transport directions (feeding direction D1, drawing back direction D2), so that the image forming portion is positioned in the transport directions (feeding direction D1, drawing back direction D2) relative to the platen roller 40. The platen roller 40 and the image forming portion (thermal head 30) can be thereby relatively aligned with a simple configuration.

The platen roller 40 is regulated from moving in the transport direction (feeding direction D1, drawing back direction D2), The parallelism of the platen roller 40 and the transport roller (driving roller 21, driven roller 23, counter roller 22) can be therefore maintained. As a result, the meandering and the wrinkle of the sheet S and the ink ribbon T and the printing error such as color shirt can be prevented.

Since the platen roller 40 can be attached to the same casing 2 as the transport rollers (driving roller 21, driven roller 23, counter roller 22), the parallelism of the platen roller 40 and the transport roller (driving roller 21, driven roller 23, counter roller 22) can be easily maintained.

The printer 1 of the embodiment includes the regulating member 32 having the first regulating portion 32*a* that extends in the directions (direction F1, direction F2) substantially vertical to the transport directions (feeding direction D1, drawing back direction D2), and regulates the movement of the image forming portion (thermal head 30) (FIG. 4).

The image forming portion (thermal head 30) can be positioned relative to the platen roller 40 in the transport directions (feeding direction D1, drawing back direction D2) with a simple configuration. The platen roller 40 and the image forming portion (thermal head 30) can be thereby aligned with a simple configuration.

In the embodiment, the position of the regulating member 32 in the transport directions (feeding direction D1, drawing back direction) is adjustable.

The image forming portion (thermal head 30) includes individual differences in its properties due to production tolerances. The most appropriate relative position of the platen roller 40 and the image forming portion (thermal head 30) differs for each image forming portion (thermal head 30).

In the embodiment, when the image forming portion (thermal head 30) is assembled, the position of the regulating member 32 in the transport directions (feeding direction D1, drawing back direction D2) can be adjusted according to the properties of the image forming portion (thermal head 30). The most appropriate relative position of the platen roller 40 and the image forming portion (thermal head 30) can be adjusted according to the properties of the image forming portion (thermal head 30).

The printer 1 of the embodiment includes the first biasing member (tension spring 38) that biases the image forming portion (thermal head 30) in the direction in which the sheet S is transported (drawing back direction D2) among the transport directions (feeding direction D1, drawing back direction D2) when the image is formed on the sheet S. The first regulating portion 32*a* regulates the image forming portion (thermal head 30) from moving in the biasing direction by the first biasing member (tension spring 38) (FIG. 4).

The biasing direction by the first biasing member (tension spring 38) thereby becomes the same as the direction in which the sheet S is transported (drawing back direction D2) when the image is formed on the sheet S. With a frictional force which occurs in the image forming portion (thermal head 30) by the transport of the sheet S, a force direction applied to the image forming portion (thermal head 30) becomes a direction which is the same as the biasing direction by the first biasing member (tension spring 38). As a result, the image forming portion (thermal head 30) can be regulated to the platen roller 40 without the influence of the transport of the sheet S.

In the printer 1 of the embodiment, the regulating member 32 is attached to the image forming portion (thermal head 30), and the first regulating portion 32*a* contacts the bearing 41 attached to the platen roller 40 outside the sheet S in the width direction (FIG. 5).

The image forming portion (thermal head 30) can be thereby positioned relative to the platen roller 40 without disturbing the transport of the sheet S.

Although the printer of the present disclosure is described as above based on the embodiment, the specific configurations are not limited to the embodiment. Any change in the design, addition, and the like are allowed as long as they do not depart from the scope of the invention according to each claim.

The embodiment describes the example that regulates the movement of the thermal head 30 in the transport direction by the first regulating portion 32*a*. However, a mechanism capable of slightly adjusting the movement of the thermal head 30 in the transport direction can be provided.

The embodiment describes the example that uses the photographic paper as the sheet S. However, the sheet is not limited to the photographic paper, and, for example, plain paper may be used.

The embodiment describes the example that uses the tension spring 38 as the first biasing member. However, the first biasing member is not limited to the tension spring.

The embodiment describes the example in which the present disclosure is applied to the sublimation type thermal transfer printer 1. However, the present disclosure is applicable to another thermal type printer.

What is claimed is:

1. A printer comprising:

a transport roller that is disposed in a casing, and configured to transport a sheet to be fed from roll paper;

an image forming portion that is disposed in a cover of the casing, and configured to form an image on the sheet; and a platen roller that is disposed in the casing to face the image forming portion, wherein the image forming portion is movable in transport directions of the sheet, the platen roller is movable in directions substantially vertical to the transport directions, the image forming portion comprises a regulating member comprising a first regulating portion that contacts the platen roller, and regulates the image forming portion from moving in a drawing back direction only opposite to a feeding direction of the sheet, when the cover is open, the image forming portion is biased by a first biasing member that biases in the drawing back direction to be located in an initial position, when the cover is closed, the first regulating portion contacts the platen roller, and the image forming portion moves to a standby position in the feeding direction from the initial position against the biasing force of the first biasing member, and in a printing operation, the platen roller moves to a pressed position which presses the image forming portion.

2. The printer according to claim 1, wherein a position of the regulating member in the transport directions is adjustable.

3. The printer according to claim 1, wherein the first biasing member biases the image forming portion in a direction in which the sheet is transported among the transport directions when an image is formed on the sheet, and the first regulating portion regulates the image forming portion from moving in a biasing direction by the first biasing member.

4. The printer according to claim 1, wherein the regulating member is attached to the image forming portion, and the first regulating portion contacts, outside the sheet in a width direction, a bearing attached to the platen roller.

* * * * *